US009248997B2

(12) United States Patent
Gassner et al.

(10) Patent No.: US 9,248,997 B2
(45) Date of Patent: Feb. 2, 2016

(54) HYDRAULIC SYSTEM AND CRANE

(71) Applicant: Liebherr-Werk Nenzing GmbH, Nenzing (AT)

(72) Inventors: Christof Gassner, Ludesch (AT); Markus Schwarzhans, Schruns (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 131 days.

(21) Appl. No.: 13/777,979

(22) Filed: Feb. 26, 2013

(65) Prior Publication Data

US 2013/0236272 A1 Sep. 12, 2013

(30) Foreign Application Priority Data

Mar. 8, 2012 (DE) ..... 10 2012 004 737

(51) Int. Cl.

| | |
|---|---|
| ***B66C 13/10*** | (2006.01) |
| ***B66D 1/52*** | (2006.01) |
| ***B63B 27/08*** | (2006.01) |
| ***F15B 7/00*** | (2006.01) |
| ***F15B 21/14*** | (2006.01) |

(52) U.S. Cl.

CPC ..... *B66C 13/10* (2013.01); *B63B 27/08* (2013.01); *B66D 1/52* (2013.01); *F15B 7/006* (2013.01); *F15B 7/008* (2013.01); *F15B 21/14* (2013.01); *F15B 2211/20546* (2013.01); *F15B 2211/20561* (2013.01); *F15B 2211/20569* (2013.01); *F15B 2211/613* (2013.01); *F15B 2211/625* (2013.01); *F15B 2211/7058* (2013.01); *F15B 2211/761* (2013.01); *F15B 2211/763* (2013.01); *F15B 2211/88* (2013.01)

(58) Field of Classification Search

USPC ..... 212/276, 307, 250; 254/277, 349, 360, 254/361; 700/282–285; 60/431, 445, 393

See application file for complete search history.

(56) References Cited

U.S. PATENT DOCUMENTS

| | | | | |
|---|---|---|---|---|
| 3,828,683 | A * | 8/1974 | Lehrer | 104/114 |
| 5,209,302 | A | 5/1993 | Robichaux et al. | |
| 6,279,370 | B1 * | 8/2001 | Awad | 72/453.02 |
| 6,932,325 | B1 * | 8/2005 | Selcer et al. | 254/275 |
| 8,499,708 | B2 * | 8/2013 | Roodenburg et al. | 114/124 |

(Continued)

FOREIGN PATENT DOCUMENTS

| | | | |
|---|---|---|---|
| DE | 8806159 | U1 | 9/1988 |
| EP | 1025922 | A1 | 8/2000 |
| WO | WO 2009/120066 | * | 10/2009 |

OTHER PUBLICATIONS

Paisson, Mats, Active Heave Compensation Winches Offer Low Weight, Power Consumption, Oct. 1, 2001, www.offshore-mag.com, Issue 10. Printed Aug. 27, 2014.*

(Continued)

*Primary Examiner* — Emmanuel M Marcelo
*Assistant Examiner* — Angela Caligiuri
(74) *Attorney, Agent, or Firm* — Alleman Hall McCoy Russell & Tuttle LLP

(57) ABSTRACT

The present disclosure relates to a hydraulic system for a crane with at least one hydraulic circuit, which comprises at least one hydraulic consumer, and a constant pressure network, wherein the at least one hydraulic circuit is coupled with the constant pressure network via at least one pressure reducer, whereby a higher volume flow with low pressure as compared to the constant pressure network can be generated in the hydraulic circuit.

18 Claims, 2 Drawing Sheets

(56) References Cited

U.S. PATENT DOCUMENTS

| | | | | |
|---|---|---|---|---|
| 2005/0179021 | A1 | 8/2005 | Selcer et al. | |
| 2008/0169131 | A1* | 7/2008 | Takeda et al. | 177/136 |
| 2010/0212311 | A1* | 8/2010 | McQuary et al. | 60/520 |

OTHER PUBLICATIONS

European Patent Office, Search Report of European Patent Application No. 12008080.9, Netherlands, May 14, 2013, 6 pages.

* cited by examiner

HYDRAULIC SYSTEM AND CRANE

CROSS REFERENCE TO RELATED APPLICATION

This application claims priority to German Patent Application No. 10 2012 004 737.1, entitled "Hydraulic System and Crane," filed Mar. 8, 2012, which is hereby incorporated by reference in its entirety for all purposes.

TECHNICAL FIELD

This present disclosure relates to a hydraulic system for a crane with at least one hydraulic circuit, which comprises at least one hydraulic consumer, and a constant pressure network.

BACKGROUND AND SUMMARY

For operating the hydraulic circuit or the hydraulic consumer a corresponding feed pressure is required. In general, a hydraulic pump generates the appropriate feed pressure by sucking in hydraulic fluid from the tank and providing the feed pressure for operating the hydraulic consumer at its outlet.

Depending on the application, a certain pressure level or a defined volume flow is required for the operation of the hydraulic consumer.

Such application exists in operation of a heave compensation device, also referred to as Active Heave Compensation. Here, it is intended to keep the load steady during the hoisting work despite the heave during deep-sea hoisting. Via the compensation device, the actuation of the hoisting winch is intervened in for this purpose.

The object of the present disclosure aims to develop such hydraulic system, in order to optimize the energy balance of the system by targeted measures.

This object is solved by a hydraulic system for a crane with at least one hydraulic circuit and a constant pressure network. At least one hydraulic circuit includes a hydraulic consumer. For optimizing the energy balance of the entire system, it is provided in accordance with the present disclosure that the required feed pressure for the hydraulic consumer is not generated by a feed pump, but instead the at least one hydraulic circuit is coupled with the constant pressure network via at least one pressure reducer.

Such pressure reducer expediently comprises at least one input and at least one output, wherein via the pressure reducer the pressure and/or volume flow present at the respective connecting points is variable.

Via the pressure reducer a low volume flow with high pressure within the constant pressure network can be convertible into a high volume flow with low pressure within the hydraulic circuit. Hence, the use of a feed pump can be omitted, since the required high volume flow in the hydraulic circuit can be supplied exclusively by the pressure reducer. This measure according to the present disclosure is advantageous in particular where a constant pressure network is installed anyway and the use of the pressure reducer renders the integration of an additional pump superfluous.

In an advantageous embodiment, the pressure reducer comprises at least two interconnected pistons with a suitable ratio of the piston surfaces. In particular, the piston with a smaller piston surface is coupled to the constant pressure network, whereas the large piston surface of the second piston is connected with the hydraulic circuit. By a suitable choice of the surface ratio, the conversion ratio and the volume flow to be achieved can selectively be taken into account.

Furthermore, it can be provided that upon reversal of the flow direction in the hydraulic circuit by which the pressure reducer a power output to the constant pressure network becomes possible. For example when a volume flow is generated at the input of the pressure reducer on the side of the hydraulic circuit, the piston unit is shifted in direction of the constant pressure network and on this side generates a low volume flow with high pressure level.

A reversal of the volume flow in the hydraulic circuit becomes possible for example in that a part of the volume flow or pressure is stored in normal operation. For this purpose, at least one pressure accumulator can be arranged in the hydraulic circuit. When the accumulator releases the stored pressure energy, the volume flow in the hydraulic circuit is reversed, so that this pressure energy can be released back to the constant pressure network via the pressure reducer.

At least one pressure storage device can be a fluid storage device, gas storage device or a storage device for other media. For example, the storage device may be an accumulator. When the form of accumulator does not correspond to the hydraulic fluid used, an air-oil actuator can be incorporated before the accumulator. For example, the storage device may be designed as air pressure accumulator and the pressure energy of the hydraulic fluid is convertible into the corresponding air pressure level via the air-oil actuator.

As hydraulic consumer a hydraulic motor expediently can be used, which may be operable in both flow directions. Hence, the hydraulic motor can be operated in a first direction of rotation by the volume flow generated via the pressure reducer and in an opposite direction of rotation via the stored energy of the storage means.

In a particular embodiment of the present disclosure, a crane cable winch, in particular a deep-sea hoisting cable winch, can be driven via the at least one hydraulic circuit or the hydraulic motor. The hydraulic motor is operated for realizing an active heave compensation whose task is to compensate the heave or heave.

By using a pressure reducer, the hydraulic fluid can be pushed back and forth between the same and possibly an arranged accumulator, which is employed in particular in the operating mode Active Heave Compensation or in similar cyclic operating modes. By the hydraulic system according to the present disclosure, the tank circulation rate can be reduced considerably. In addition, the system is characterized by a particularly efficient energy recovery.

The present disclosure furthermore relates to a crane which includes the hydraulic system according to the present disclosure or an advantageous embodiment of the hydraulic system. The advantages and properties of the crane quite obviously correspond to those of the hydraulic system, so that a renewed description will be omitted at this point.

The crane can include a deep-sea hoisting cable winch which is supplied by a hydraulic drive. In particular, a closed hydraulic circuit with at least one hydraulic motor serves to put the hoisting cable winch in rotation for carrying out a winding or unwinding movement. In addition, the crane can comprise a constant pressure network, which can be supplied by a central hydraulic pump and is used for feeding one or more hydraulic consumers, in particular various crane components.

Furthermore, the crane includes a hydraulic circuit according to the hydraulic system in accordance with the present disclosure. The integrated hydraulic motor can be part of a heave compensation device. The winch here is driven separately by the hydraulic motor, in order to be able to compensate the heave during the actual hoisting work.

Further advantages and details of the present disclosure will be described in detail with reference to two drawings.

DETAILED DESCRIPTION

Figure 1:
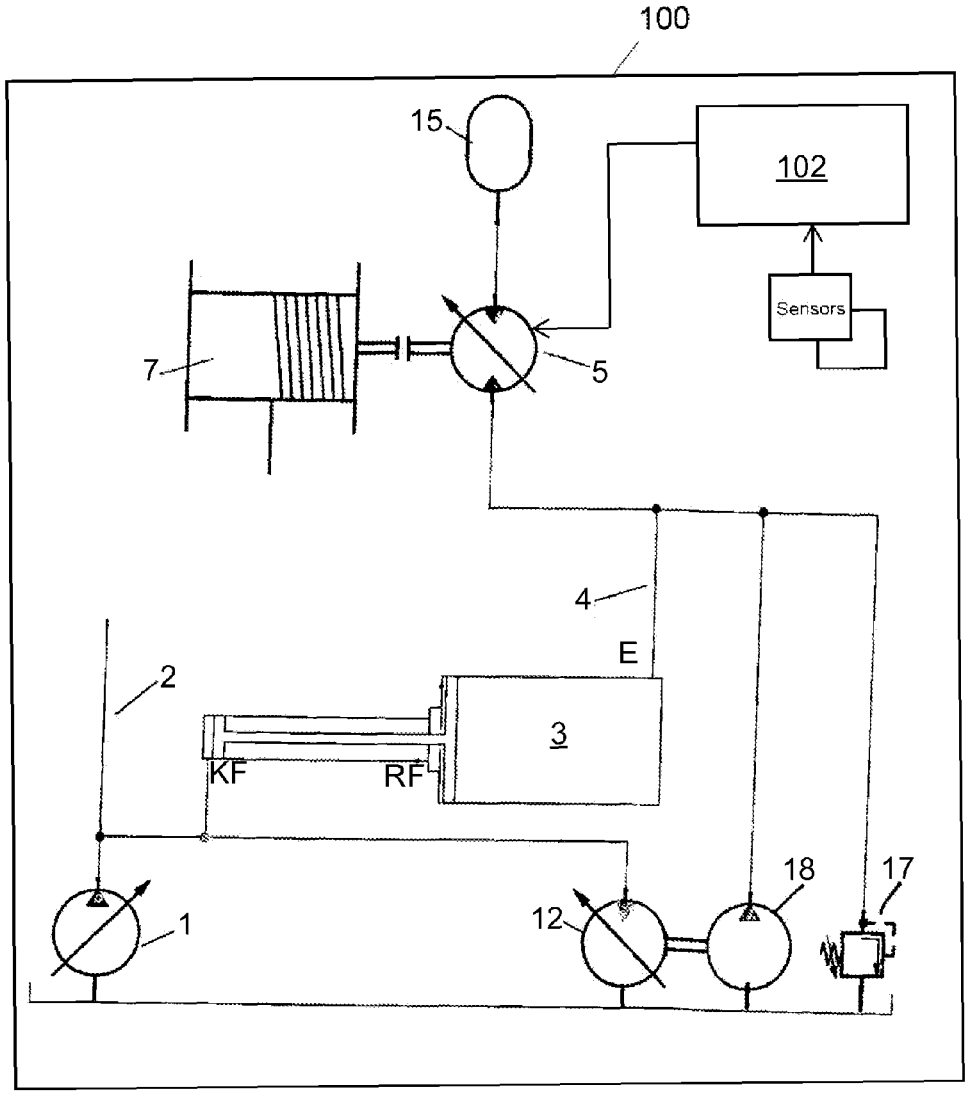
FIG. 1 shows an embodiment of a hydraulic system for operating an offshore crane.
Figure 2:
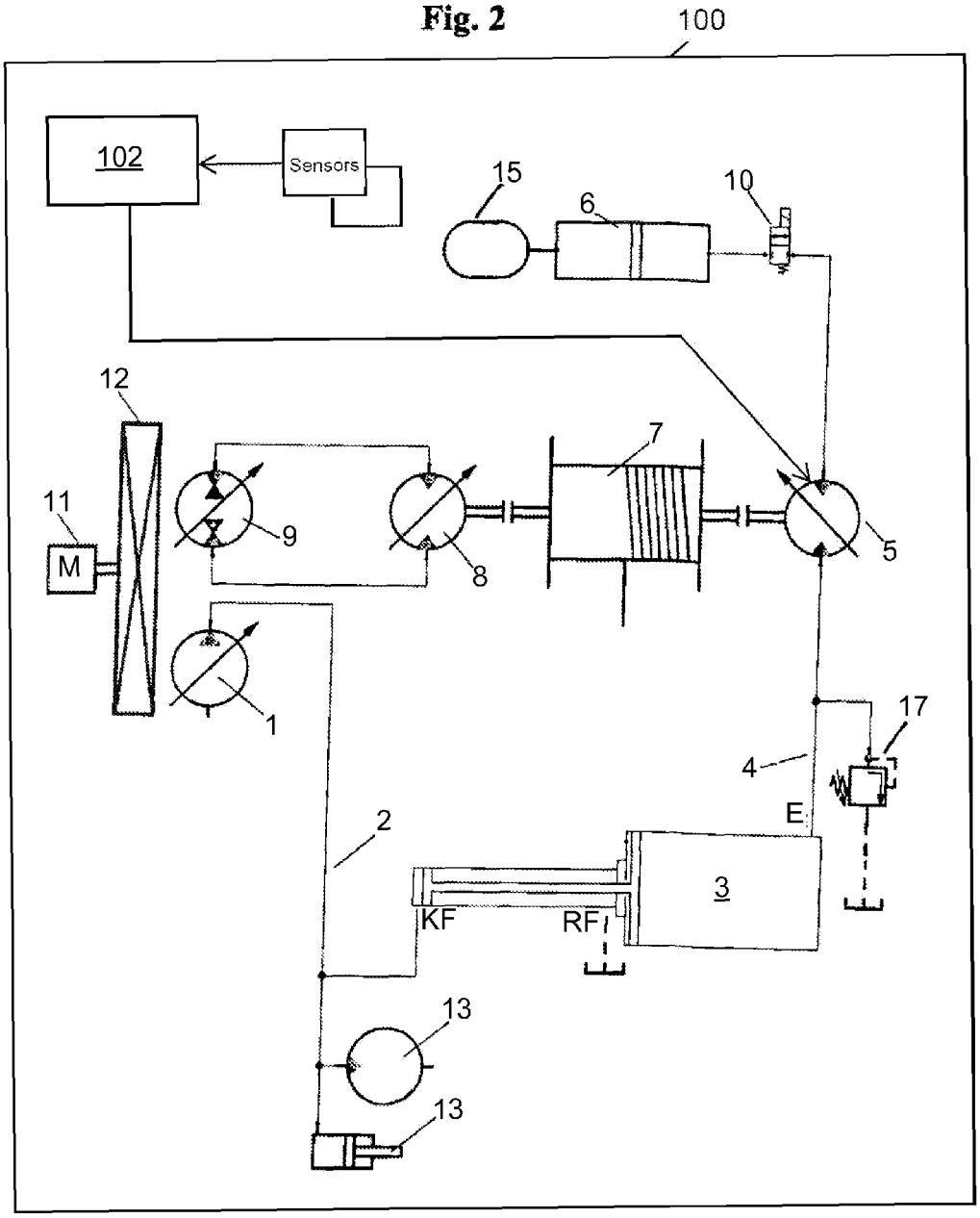
FIG. 2 shows an embodiment of a hydraulic system for operating an offshore crane.

The two FIGS. 1, 2 show an embodiment of the hydraulic system according to the present disclosure for operating an offshore crane 100. The crane or the hydraulic system in particular is constructed for deep-sea hoisting, and thus the offshore crane 100 may be a deep-sea hoisting crane. Beside the actual hydraulic drive of the deep-sea hoisting winch a heave compensation device 102 is installed.

The structure of the hydraulic system shown in FIGS. 1, 2 comprises a constant pressure network 2 with a relatively high pressure level. For generating the constant pressure the hydraulic pump 1 is provided, which sucks in hydraulic oil from the tank and brings the same to the corresponding pressure level of the constant pressure network 2.

In FIG. 2, two hydraulic consumers 13 in the form of a hydraulic motor and a hydraulic cylinder additionally are depicted, which each are fed with the pressure level of the constant pressure network 2 via the hydraulic pump 1. Both consumers 13, however, are just representative for a possible structure of the constant pressure network 2. In principle, any number of identical or different hydraulic components can be arranged in the constant pressure network 2 or be connected with the same.

For driving the deep-sea hoisting cable winch 7 a closed hydraulic circuit is available, including the pump motor unit 9 and the hydraulic motor 8 operable in both flow directions.

The crane furthermore comprises a drive motor 11 with a transmission 12. Beside the hydraulic pump 1 for feeding the constant pressure network 2, the pump motor unit 9 of the closed circuit additionally is seated on the drive shaft 12.

The cable winch 7 chiefly is driven by the closed circuit, i.e. the hydraulic motor 8 both in winding and in unwinding direction, in order to carry out the required hoisting work.

Since during deep-sea hoisting the crane is subject to the external influences of the heave, a basically known heave compensation device 102 is provided, which is meant to compensate the heave via an additional actuation of the cable winch 7. The heave compensation device may include various sensors and computer readable instructions to determine operating conditions and adjust devices, such as cable winch 7 via actuators as described herein.

For realizing the heave compensation device, which also is referred to as Active Heave Compensation, the hydraulic circuit 4 is employed. The same comprises a hydraulic motor 5 operable in both flow directions, whose torque likewise drives the cable winch 7 in both directions. At the same time, the motor 5 is designed as adjusting unit.

For feeding the hydraulic motor 5, a particularly high volume flow is required, which often goes up into regions of several thousand l/minute. According to the present disclosure, this high volume flow is not realized via a separate feed pump, as known from the prior art, but is effected by coupling the constant pressure network 2 to the circuit 4 by the pressure reducer 3.

The pressure reducer 3 includes two pistons which have a common piston rod with different piston surfaces at the rod end faces. The piston surface with smaller circumference is connected with the constant pressure network 2, whereas the relatively large piston surface of the second cylinder is connected with the hydraulic circuit 4.

The chosen surface ratio of the two piston surfaces effects that the small volume flow with high pressure from the constant pressure network 2 is converted into a high volume flow with low pressure within the hydraulic circuit 4. For example, the ratio of the higher surface area to the lower surface area is greater than 1.

The pressure reducer 3 performs the feeding of hydraulic oil, which prevents running-dry of the system. For this purpose, the pressure reducer 3 is connected with an input of the hydraulic motor 5. Via a directional valve 10 and an air-oil actuator 6, a storage device 15 is connected to the output of the hydraulic motor 5, via which the hoisting work is performed.

To avoid pressure overloads in the hydraulic circuit 4, a pressure limiting valve 17 additionally is arranged, which upon reaching a certain limit pressure level releases excess hydraulic oil to the tank.

As can be taken from FIG. 1, an additional hydraulic pump 18 alternatively can be provided in the hydraulic circuit 4, in order to be able to ensure a certain pressure level or a certain volume flow. The hydraulic pump 18 is seated on a common drive shaft with the adjustable motor 12 of the constant pressure network 2.

The invention claimed is:

1. A hydraulic system for a crane comprising at least one hydraulic circuit, which comprises at least one hydraulic consumer, and a constant pressure network, wherein the at least one hydraulic circuit is coupled with the constant pressure network via at least one pressure reducer, wherein a higher volume flow with low pressure as compared to the constant pressure network is generated in the at least one hydraulic circuit via the pressure reducer, and wherein the pressure reducer comprises at least first and second interconnected pistons having a common piston rod, a surface of the first piston coupled with the constant pressure network and a surface of the second piston coupled with the at least one hydraulic circuit, the surface of the first piston having a different surface area than the surface of the second piston.

2. The hydraulic system according to claim 1, wherein a ratio of the surface area of the second piston to the surface area of the first piston is greater than 1.

3. The hydraulic system according to claim 1, wherein upon reversal of a flow direction of the at least one hydraulic circuit, pressure energy is released to the constant pressure network via the pressure reducer.

4. The hydraulic system according to claim 1, wherein at least one pressure accumulator is provided in the at least one hydraulic circuit, wherein in the at least one accumulator pressure energy is stored, which upon flow reversal is released to the constant pressure network via the pressure reducer.

5. The hydraulic system according to claim 4, wherein the at least one pressure accumulator is incorporated via at least one air-oil actuator.

6. The hydraulic system according to claim 5, wherein the at least one hydraulic consumer of the at least one hydraulic circuit comprises a hydraulic motor which is operable in two flow directions.

7. The hydraulic system according to claim 6, wherein the hydraulic motor is operable in a first direction of rotation via the volume flow generated by the pressure reducer and is operable in a second direction of rotation via the pressure energy stored in the at least one pressure accumulator.

8. The hydraulic system according to claim 7, wherein via the at least one hydraulic circuit or the hydraulic motor, a crane cable winch is driven to compensate heave.

9. The hydraulic system according to claim 1, further comprising a crane cable winch driven by the at least one hydraulic circuit, wherein the crane is an offshore crane, and wherein the crane cable winch is a deep sea hoisting cable winch.

10. The hydraulic system according to claim 9, wherein the at least one hydraulic circuit comprises a closed hydraulic circuit, and wherein the deep sea hoisting cable winch is driven via a hydraulic motor in the closed hydraulic circuit in order to compensate heave.

11. A method of operating a hydraulic system for a crane, the hydraulic system including at least one hydraulic circuit with at least one hydraulic consumer and a constant pressure network, wherein the at least one hydraulic circuit is coupled with the constant pressure network via at least one pressure reducer, the method comprising:

generating a higher volume flow with low pressure as compared to the constant pressure network in the hydraulic circuit via the pressure reducer, wherein a required feed pressure for the hydraulic consumer is not generated by a feed pump; and compensating heave by driving a crane cable winch via the at least one hydraulic circuit or a hydraulic motor, wherein the pressure reducer comprises at least first and second interconnected pistons having a common piston rod, a surface of the first piston coupled with the constant pressure network and a surface of the second piston coupled with the at least one hydraulic circuit, the surface of the first piston having a different surface area than the surface of the second piston.

12. The method according to claim 11, wherein a ratio of the surface area of the second piston to the surface area of the first piston is greater than 1.

13. The method according to claim 12, the method further comprising releasing stored energy to the constant pressure network via the pressure reducer in response to reversal of a flow direction of the at least one hydraulic circuit pressure.

14. The method according to claim 13, wherein the system includes at least one pressure accumulator in the at least one hydraulic circuit, the method further comprising storing pressure energy in the at least one pressure accumulator, which upon flow reversal is released to the constant pressure network via the pressure reducer.

15. The method according to claim 14, wherein the at least one pressure accumulator is incorporated via at least one air-oil actuator.

16. The method according to claim 15, wherein the at least one hydraulic consumer of the at least one hydraulic circuit comprises a hydraulic motor which is operable in two flow directions.

17. The method according to claim 16, wherein the hydraulic motor is operable in a first direction of rotation via the volume flow generated by the pressure reducer and is operable in a second direction of rotation via the pressure energy stored in the at least one pressure accumulator.

18. The method according to claim 17, wherein the crane is an offshore crane, and wherein the crane cable winch is a deep sea hoisting cable winch.

* * * * *